US012007113B2

(12) United States Patent
Rybak-Tucholska et al.

(10) Patent No.: US 12,007,113 B2
(45) Date of Patent: Jun. 11, 2024

(54) GAS TURBINE COMPONENT WITH FLUID INTAKE HOLE FREE OF ANGLED SURFACE TRANSITIONS

(71) Applicant: GENERAL ELECTRIC COMPANY, Schenectady, NY (US)

(72) Inventors: Maria Rybak-Tucholska, Warsaw (PL); Vladimir Belyaev, Greenville, SC (US); James W. Vehr, Easley, SC (US)

(73) Assignee: GE INFRASTRUCTURE TECHNOLOGY LLC, Greenville, SC (US)

( * ) Notice: Subject to any disclaimer, the term of this patent is extended or adjusted under 35 U.S.C. 154(b) by 0 days.

(21) Appl. No.: 17/370,080

(22) Filed: Jul. 8, 2021

(65) Prior Publication Data

US 2022/0333776 A1 Oct. 20, 2022

(30) Foreign Application Priority Data

Apr. 20, 2021 (PL) ..... 437651

(51) Int. Cl.

| | |
|---|---|
| ***F23R 3/00*** | (2006.01) |
| ***F01D 9/02*** | (2006.01) |
| ***F23R 3/06*** | (2006.01) |
| ***F23R 3/34*** | (2006.01) |

(52) U.S. Cl.

CPC ..... *F23R 3/002* (2013.01); *F01D 9/023* (2013.01); *F23R 3/06* (2013.01); *F23R 3/346* (2013.01); *F23R 2900/03041* (2013.01); *F23R 2900/03042* (2013.01); *F23R 2900/03044* (2013.01)

(58) Field of Classification Search

CPC .. F01D 9/023; F23R 3/06; F23R 3/002; F23R 2900/03041; F23R 2900/03042; F23R 2900/03044; F23R 3/346

See application file for complete search history.

(56) References Cited

U.S. PATENT DOCUMENTS

| | | | |
|---|---|---|---|
| 3,981,142 | A | 9/1976 | Irwin |
| 9,377,199 | B2 | 6/2016 | Radliez et al. |
| 10,088,162 | B2 | 10/2018 | Bangerter et al. |
| 2010/0186416 | A1 | 7/2010 | Chen et al. |

(Continued)

*Primary Examiner* — Gerald L Sung
*Assistant Examiner* — Rene D Ford
(74) *Attorney, Agent, or Firm* — McNees Wallace & Nurick LLC

(57) ABSTRACT

A gas turbine combustion duct includes a duct body and a fluid intake hole. The duct body includes a duct wall defining a plenum for routing a flow of combustion products from a combustor downstream through the gas turbine combustion duct to a turbine section. The fluid intake hole extends from an outward-facing surface to an inward-facing surface through the duct wall for receiving an outside fluid flow into the plenum, and is laterally circumscribed about its entire periphery by a lateral-facing surface. The lateral-facing surface includes a curved surface portion along a shortest path from the inward-facing surface to the outward-facing surface and is free of angled surface transitions along the shortest path between the inward-facing surface and the outward-facing surface. The fluid intake hole is wider at the outward-facing surface than at the inward-facing surface. A boss may define the fluid intake hole and the lateral-facing surface.

17 Claims, 8 Drawing Sheets

(56) References Cited

U.S. PATENT DOCUMENTS

| | | | | |
|---|---|---|---|---|
| 2010/0293957 | A1* | 11/2010 | Chen | F01D 25/12 415/177 |
| 2012/0036859 | A1 | 2/2012 | Johnson et al. | |
| 2012/0247111 | A1* | 10/2012 | Narcus | F23R 3/002 60/752 |
| 2014/0150452 | A1 | 6/2014 | Pohlman et al. | |
| 2016/0025342 | A1* | 1/2016 | Erbas-Sen | F02C 7/18 415/178 |
| 2016/0186998 | A1* | 6/2016 | Kostka, Jr. | F23R 3/002 415/115 |
| 2016/0209035 | A1* | 7/2016 | Cramer | F23R 3/045 |
| 2018/0283695 | A1* | 10/2018 | Quach | F23R 3/007 |
| 2019/0024894 | A1* | 1/2019 | Mongillo | F02C 3/04 |
| 2019/0353349 | A1* | 11/2019 | Papple | F23R 3/002 |

* cited by examiner

GAS TURBINE COMPONENT WITH FLUID INTAKE HOLE FREE OF ANGLED SURFACE TRANSITIONS

CROSS REFERENCE TO RELATED APPLICATIONS

This application relates to and claims the benefit of and priority to Polish Patent Application No. P.437651, filed Apr. 20, 2021, entitled "Gas Turbine Component with Fluid Intake Hole Free of Angled Surface Transitions," which is hereby incorporated by reference in its entirety.

FIELD

The present disclosure is directed to gas turbine components with fluid intake holes. More particularly, the present disclosure is directed to gas turbine components with fluid intake holes free of angled surface transitions.

BACKGROUND

Gas turbines may include one or more combustors, each having a transition piece disposed downstream of the one or more combustor liners and upstream of a gas turbine first stage nozzle in a turbine section of the gas turbine, such that the transition piece associated with each combustor routes combustion products from the combustor to the first stage nozzle. These combustion products from the combustion of an air-fuel mixture travel through the combustor to the gas turbine, defining a hot gas path characterized by extreme conditions.

Fluid intake holes, such as dilution holes and mixing holes, may be disposed in the wall of the combustor liner or the transition piece (or a unibody combustor, which is a unitary component combining a combustor liner and a transition piece), collectively referred to as a "gas turbine combustion duct." The fluid intake holes intake an external fluid into the gas turbine combustion duct to adjust the air-fuel mixture or the stream of combustion products in the hot gas path. However, due to the fluid dynamics of the hot gas path, the stream of combustion products flowing through the gas turbine combustion duct may be ingested into the fluid intake holes against the flow of the external fluid. Such ingestion of the stream of combustion products into the fluid intake holes may locally degrade the gas turbine combustion duct, potentially leading to cracking or failure.

BRIEF DESCRIPTION

In an exemplary embodiment, a gas turbine combustion duct includes a duct body and a fluid intake hole. The duct body has an upstream end and a downstream end, the duct body including a duct wall defining a plenum for routing a flow of combustion products from upstream in a combustor downstream through the gas turbine combustion duct to a gas turbine first stage nozzle. The duct wall has an inward-facing surface adjacent to the plenum, an outward-facing surface opposite the inward-facing surface, and a duct wall thickness between the inward-facing surface and the outward-facing surface. The fluid intake hole extends from the outward-facing surface to the inward-facing surface through the duct wall thickness for receiving a fluid flow from outside the plenum into the plenum, the fluid intake hole being laterally circumscribed about its entire periphery between the outward-facing surface and the inward-facing surface by a lateral-facing surface. The lateral-facing surface includes a curved surface portion along a shortest path from the inward-facing surface to the outward-facing surface and is free of angled surface transitions along the shortest path between the inward-facing surface and the outward-facing surface. The fluid intake hole is wider at the outward-facing surface than at the inward-facing surface. Other features and advantages of the present gas turbine combustion duct will be apparent from the following more detailed description of the preferred embodiment, taken in conjunction with the accompanying drawings, which illustrate, by way of example, the principles of the invention.

Further aspects of the subject matter of the present disclosure are provided by the following clauses:

1. A gas turbine combustion duct, comprising: a duct body having an upstream end and a downstream end, the duct body including a duct wall defining a plenum for routing a flow of combustion products from upstream in a combustor through the gas turbine combustion duct downstream to a turbine section of a gas turbine, the duct wall having an inward-facing surface adjacent to the plenum, an outward-facing surface opposite the inward-facing surface, and a duct wall thickness between the inward-facing surface and the outward-facing surface; and a fluid intake hole extending from the outward-facing surface to the inward-facing surface through the duct wall thickness for receiving a fluid flow from outside the plenum into the plenum, the fluid intake hole being laterally circumscribed about its entire periphery between the outward-facing surface and the inward-facing surface by a lateral-facing surface, wherein: the lateral-facing surface includes a curved surface portion along a shortest path from the inward-facing surface to the outward-facing surface, the lateral-facing surface is free of angled surface transitions along the shortest path between the inward-facing surface and the outward-facing surface, and the fluid intake hole is wider at the outward-facing surface than at the inward-facing surface.

2. The gas turbine combustion duct of any preceding clause, wherein the gas turbine combustion duct is selected from the group consisting of a transition piece, a combustion liner, and a unibody combustor.

3. The gas turbine combustion duct of any preceding clause, wherein the gas turbine combustion duct is a transition piece, the plenum is disposed for routing a flow of combustion products from a combustor liner through the gas turbine transition piece to a gas turbine first stage nozzle.

4. The gas turbine combustion duct of any preceding clause, wherein the fluid intake hole is either a dilution hole or a mixing hole.

5. The gas turbine combustion duct of any preceding clause, wherein the lateral-facing surface includes a frusto-conical topology immediately adjacent to the inward-facing surface.

6. The gas turbine combustion duct of any preceding clause, wherein the inward-facing surface and the lateral-facing surface meet at an angled joint.

7. The gas turbine combustion duct of any preceding clause, wherein the inward-facing surface and the lateral-facing surface meet at a radiused joint.

8. The gas turbine combustion duct of any preceding clause, wherein the lateral-facing surface is disposed within 2 degrees of perpendicular from the inward-facing surface adjacent to a joint between the inward-facing surface and the lateral-facing surface.

9. The gas turbine combustion duct of any preceding clause, wherein the lateral-facing surface is disposed at an acute angle of at least 5 degrees from perpendicular from the inward-facing surface adjacent to a joint between the inward-facing surface and the lateral-facing surface.

10. The gas turbine combustion duct of any preceding clause, wherein the outward-facing surface and the lateral-facing surface meet at an angled joint.

11. The gas turbine combustion duct of any preceding clause, wherein the outward-facing surface and the lateral-facing surface meet at a radiused joint.

12. The gas turbine combustion duct of any preceding clause, wherein the lateral-facing surface curves along the entirety of the shortest path from the inward-facing surface to the outward-facing surface.

13. The gas turbine combustion duct of any preceding clause, wherein: the duct wall includes a boss portion, the boss portion being immediately adjacent to and surrounding the fluid intake hole; the boss portion including the lateral-facing surface and being disposed between the fluid intake hole and a sheet portion of the duct wall, the sheet portion constituting a majority of the duct wall; the boss portion including a transition from the lateral-facing surface to the outward-facing surface at a zenith of the boss portion having a maximum thickness of the duct wall in the boss portion; and the duct wall thickness at the boss portion being greater than the duct wall thickness at the sheet portion.

14. The gas turbine combustion duct of any preceding clause, wherein the zenith of the boss portion is a flat outward-facing surface.

15. The gas turbine combustion duct of any preceding clause, wherein the zenith of the boss portion is an apex curved surface.

16. The gas turbine combustion duct of any preceding clause, wherein, in defining the fluid intake hole, the boss portion transitions from the zenith of the boss portion to the sheet portion of the duct wall with a curved transition surface free of angled surface transitions.

17. The gas turbine combustion duct of any preceding clause, wherein the boss portion and the sheet portion are a continuous and unitary structure free of joints between the boss portion and the sheet portion.

18. The gas turbine combustion duct of any preceding clause, wherein the boss portion is attached to the sheet portion with a weld joint.

19. The gas turbine combustion duct of any preceding clause, wherein the boss portion is mechanically attached to the sheet portion.

20. The gas turbine combustion duct of any preceding clause, wherein the maximum thickness of the duct wall in the boss portion is at least 150% of the duct wall thickness at the sheet portion.

21. The gas turbine combustion duct of any preceding clause, wherein the sheet portion of the duct wall is formed of NIMONIC 263, and the boss portion is formed of HASTELOY 230.

22. The gas turbine combustion duct of any preceding clause, wherein the boss portion at the inward-facing surface of the duct wall is flush with the inward-facing surface of the sheet portion of the duct wall such that the plenum is free of intrusion of the boss portion into the plenum.

BRIEF DESCRIPTION OF THE DRAWINGS

These and other features, aspects, and advantages of the present subject matter will become better understood when the following detailed description is read with reference to the accompanying drawings in which.

Wherever possible, the same reference numbers will be used throughout the drawings to represent the same parts.

DETAILED DESCRIPTION

Provided are exemplary gas turbine combustion ducts and methods for forming gas turbine combustion ducts. Embodiments of the present disclosure, in comparison to gas turbine combustion ducts and methods for forming gas turbine combustion ducts not utilizing one or more features disclosed herein, decrease costs, increase manufacturing control, increase product lifetime, decrease product degradation, decrease or eliminate crack occurrence, or combinations thereof.

Figure 1:
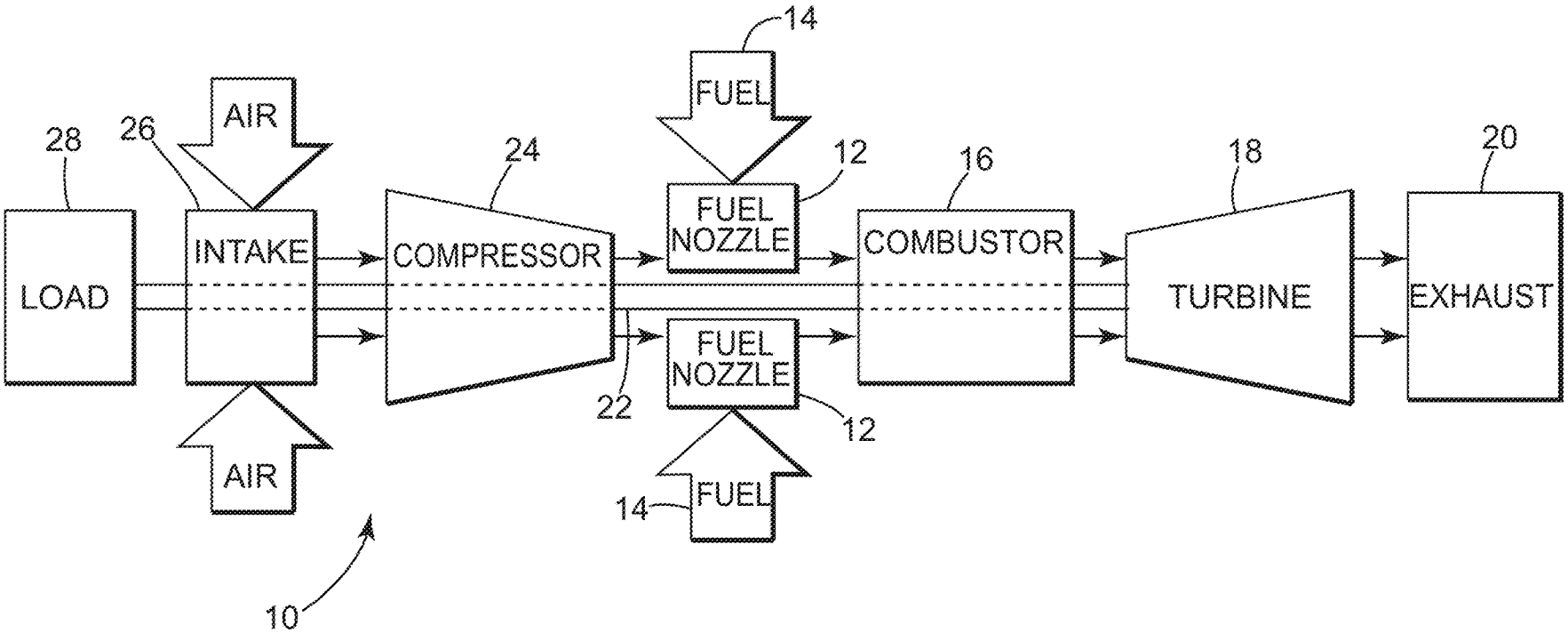
FIG. 1 is a block diagram of an embodiment of a gas turbine having a combustor with a gas turbine combustion duct, wherein the gas turbine combustion duct includes fluid intake holes.

FIG. 1 is a block diagram of an embodiment of a gas turbine 10 (e.g., gas turbine engine or system) having a combustor 16 that may include a gas turbine combustion duct, such as a combustor liner or transition piece, with mixing holes and/or dilution holes. The gas turbine 10 may use liquid or gas fuel to run the gas turbine 10. Examples of fuels may include natural gas, hydrogen rich synthetic gas, propane, ethane, distillate (diesel) fuels, nitrogen-doped fuel sources, hydrogen-poor fuel sources (e.g., blast furnace gases), and/or any other fuel source for a gas turbine 10. As depicted, a plurality of fuel nozzles 12 intakes a fuel supply 14, mixes the fuel with air, and distributes the air-fuel mixture into the combustor 16. In certain embodiments, the gas turbine 10 includes more than one combustor 16 (e.g., arranged in a can-annular array about a turbine rotor), each having a gas turbine combustion duct. The air-fuel mixture combusts in a chamber within combustor 16, thereby creating hot combustion products. The combustor 16 directs the hot combustion products to and through a turbine section 18 (having a first stage nozzle 30 disposed toward the upstream portion thereof) toward an exhaust outlet 20.

As the hot combustion products pass through the turbine section 18, the hot combustion products force one or more turbine blades to rotate a shaft 22 along an axis of the gas turbine 10. As illustrated, the shaft 22 may be connected to various components of gas turbine 10, including a compressor 24. The compressor 24 also includes blades that may be coupled to the shaft 22. As the shaft 22 rotates, the blades within the compressor 24 also rotate, thereby compressing air from an air intake 26 through the compressor 24 and into the fuel nozzles 12 and/or the combustor 16. The shaft 22 may also be connected to a load 28, which may be a vehicle or a stationary load, such as an electrical generator in a power plant, or a propeller on an aircraft, for example. As will be understood, the load 28 may include any suitable device capable of being powered by the rotational output of gas turbine 10.

In operation, air enters the gas turbine 10 through the air intake 26 and may be pressurized in the compressor 24. The compressed air may then be mixed with gas for combustion within combustor 16. For example, the fuel nozzles 12 may inject a fuel-air mixture into the combustor 16 in a suitable ratio for optimal combustion, emissions, fuel consumption, and power output. The combustion generates hot pressurized exhaust gases (combustion products), which then drive one or more blades within the turbine section 18 to rotate the shaft 22 and, thus, the compressor 24 and the load 28. The rotation of the turbine blades causes a rotation of shaft 22, thereby causing blades within the compressor 24 to draw in and pressurize the air received by the intake 26.

Figure 2:
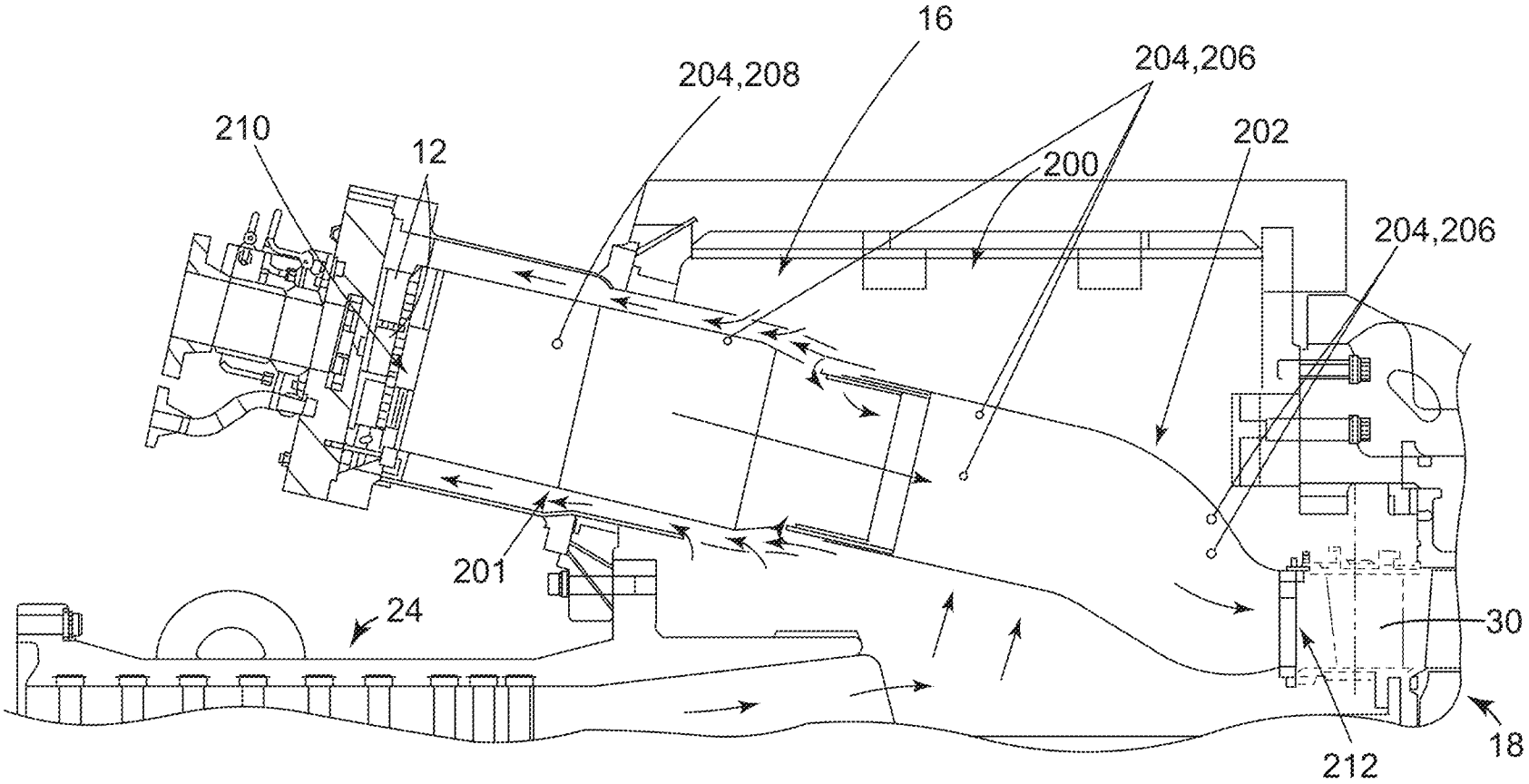
FIG. 2 is a cross-sectional view of an embodiment of a combustor having a gas turbine combustion duct, wherein the gas turbine combustion duct includes fluid intake holes.

FIG. 2 is a partial cross-sectional view of an embodiment of the gas turbine 10, illustrating a gas turbine combustor 16. The combustor 16 may include a combustor liner 201 and a transition piece 202 coupled to the downstream end of the combustor liner 201. Alternatively, a unibody combustor, which is a unitary combustor liner 201 and transition piece 202 combined, may be used. For purposes of discussion herein, the term "gas turbine combustion duct" 200 may be used to describe a combustor liner 201, a transition piece 202, or a unibody combustor (not shown). The transition piece 202 is downstream of the combustor liner 201 and upstream of the turbine section 18. As used herein, the terms "upstream" and "downstream" shall be understood to relate to the flow of combustion gases from the combustor head end 210 through the combustor liner 201, through the transition piece 202 and its associated aft frame 212, and into the turbine section 18. The gas turbine combustion duct 200 includes any suitable number of fluid intake holes 204. A fluid intake hole 204 may be a dilution hole 206 or a mixing hole 208.

Figure 3:
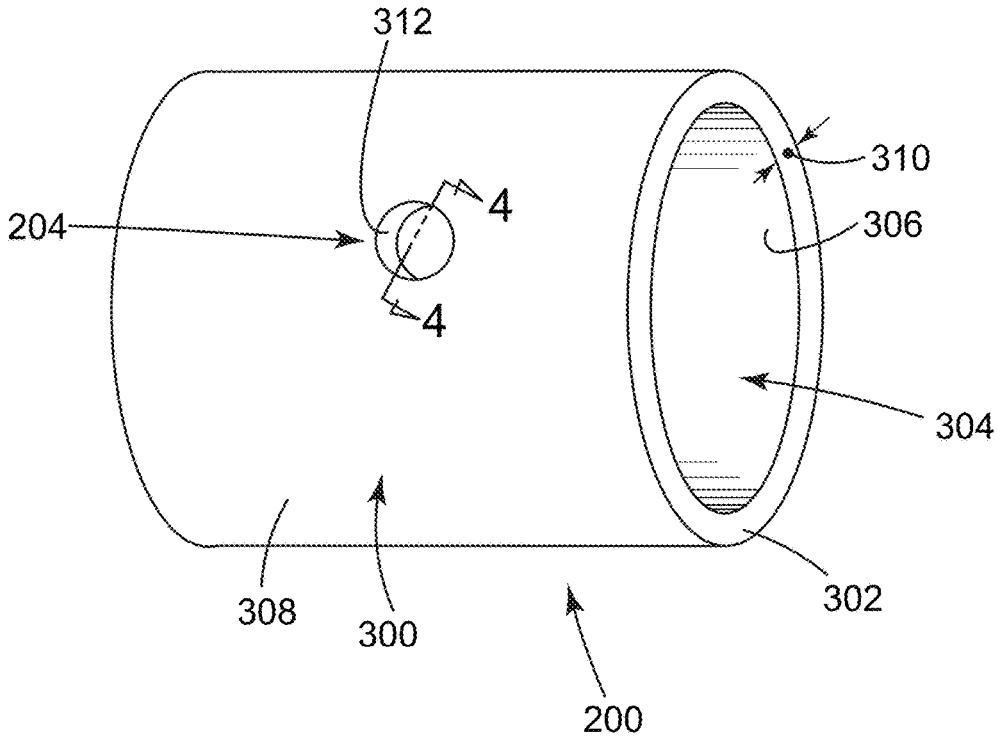
FIG. 3 is a representative schematic of a gas turbine combustion duct with a fluid intake hole, according to an embodiment of the disclosure.

Referring to FIG. 3, the gas turbine combustion duct 200 includes a duct body 300 having a duct wall 302 defining a plenum 304 for routing a flow of combustion products within the combustor 16 through the gas turbine combustion duct 200 downstream to the turbine section 18 (e.g., a gas turbine first stage nozzle 30 in the turbine section 18). The duct wall 302 has an inward-facing surface 306 adjacent to the plenum 304, an outward-facing surface 308 opposite the inward-facing surface 306, and a duct wall thickness 310 between the inward-facing surface 306 and the outward-facing surface 308. A fluid intake hole 204 extends from the outward-facing surface 308 to the inward-facing surface 306 through the duct wall thickness 310 for receiving a fluid flow from outside the plenum 304 into the plenum 304. The fluid intake hole 204 is laterally circumscribed about its entire periphery between the outward-facing surface 308 and the inward-facing surface 306 by a lateral-facing surface 312.

Figure 4:
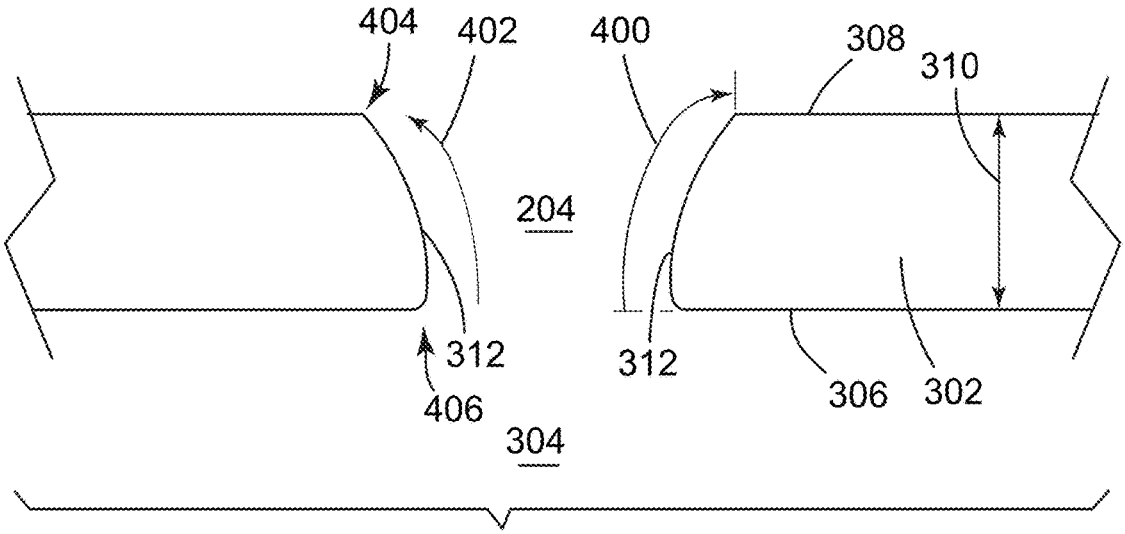
FIG. 4 is a cross-sectional view taken along line 4-4 of a fluid intake hole of FIG. 3, according to an embodiment of the disclosure.

Referring to FIG. 4, the lateral-facing surface 312 includes a curved surface portion 400 along a shortest path 402 from the inward-facing surface 306 to the outward-facing surface 308. The lateral-facing surface 312 is free of angled surface transitions along the shortest path 402 between the inward-facing surface 306 and the outward-facing surface 308. The fluid intake hole 204 is wider at the outward-facing surface 308 than at the inward-facing surface 306. That is, the diameter of the fluid intake hole 204 at the outward-facing surface 308 is larger than the diameter of the fluid intake hole 204 at the inward-facing surface.

Figure 5:
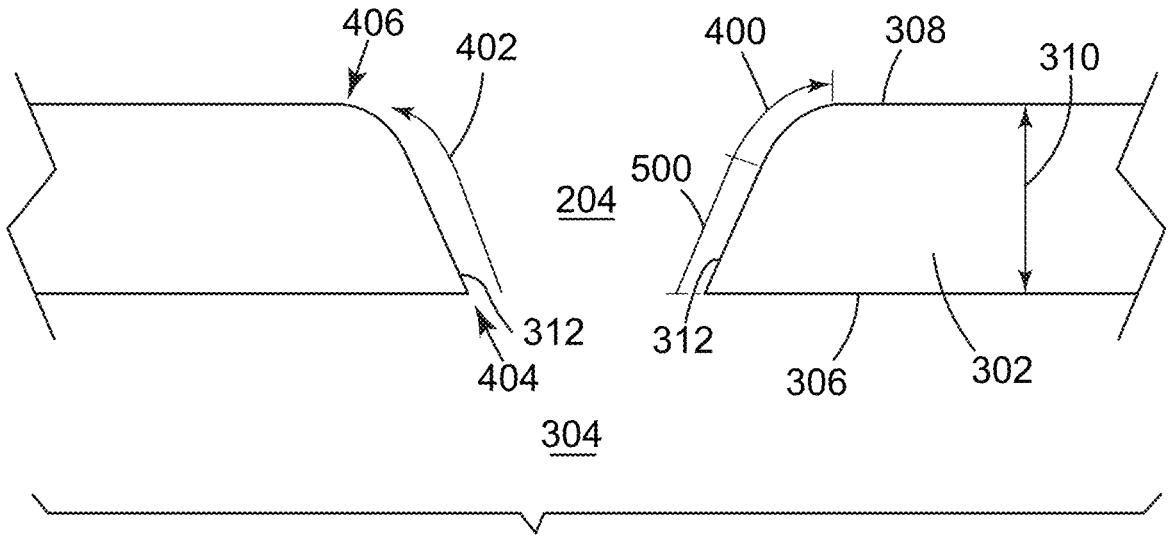
FIG. 5 is a cross-sectional view taken along line 4-4 of a fluid intake hole of FIG. 3, according to an alternate embodiment of the disclosure.

Referring to FIG. 5, in one embodiment, the lateral-facing surface 312 includes a frustoconical topology 500 immediately adjacent to the inward-facing surface 306.

Referring to FIGS. 4 and 5, the inward-facing surface 306 and the lateral-facing surface 312 may meet at an angled joint 404 (FIG. 5) or a radiused joint 406 (FIG. 4), and the outward-facing surface 308 and the lateral-facing surface 312 may meet at an angled joint 404 (FIG. 4) or a radiused joint 406 (FIG. 5). Both such joints may be angled joints 404 in a single embodiment, or both such joints may be radiused joints 406 in a single embodiment, as well.

Figure 6:
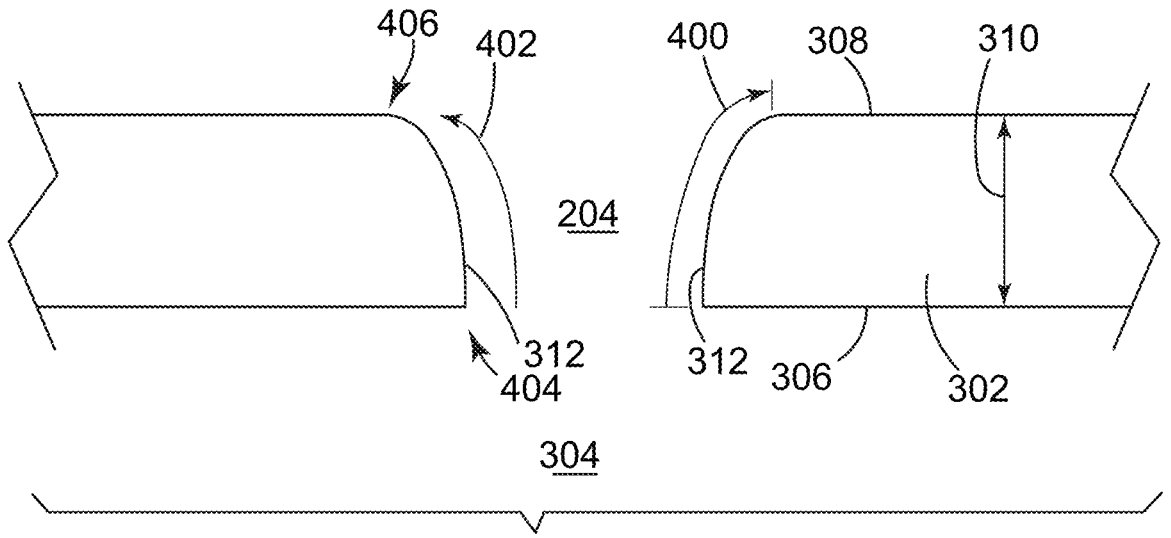
FIG. 6 is a cross-sectional view taken along line 4-4 of a fluid intake hole of FIG. 3, according to an alternate embodiment of the disclosure.
Figure 7:
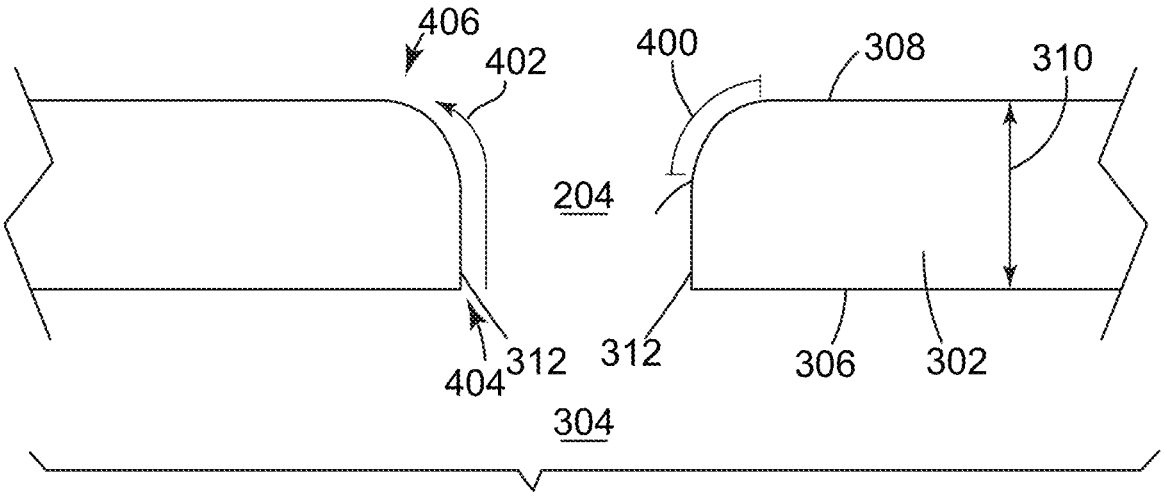
FIG. 7 is a cross-sectional view taken along line 4-4 of a fluid intake hole of FIG. 3, according to an alternate embodiment of the disclosure.

Referring to FIGS. 6 and 7, in one embodiment, the lateral-facing surface 312 is disposed within 2 degrees, alternatively within 1 degree, alternatively within 0.5 degrees, alternatively within 0.1 degrees, of perpendicular from the inward-facing surface 306 adjacent to an angled joint 404 between the inward-facing surface 306 and the lateral-facing surface 312.

Referring to FIG. 5, in another embodiment the lateral-facing surface 312 is disposed at an acute angle of at least 5 degrees, alternatively at least 10 degrees, alternatively at least 15 degrees, from perpendicular from the inward-facing surface 306 adjacent to an angled joint 404 between the inward-facing surface 306 and the lateral-facing surface 312.

Referring to FIGS. 4 and 6, the lateral-facing surface 312 may curve along the entirety of the shortest path 402 from the inward-facing surface 306 to the outward-facing surface 308. Alternatively, referring to FIGS. 5 and 7, the lateral-facing surface 312 may curve along less than the entirety of the shortest path 402 from the inward-facing surface 306 to the outward-facing surface 308. More particularly, the lateral-facing surface 312 may curve along less than the entirety of the shortest path 402 in a portion of the lateral-facing surface 312 that is proximate to and intersects the outward-facing surface 308.

Figure 8:
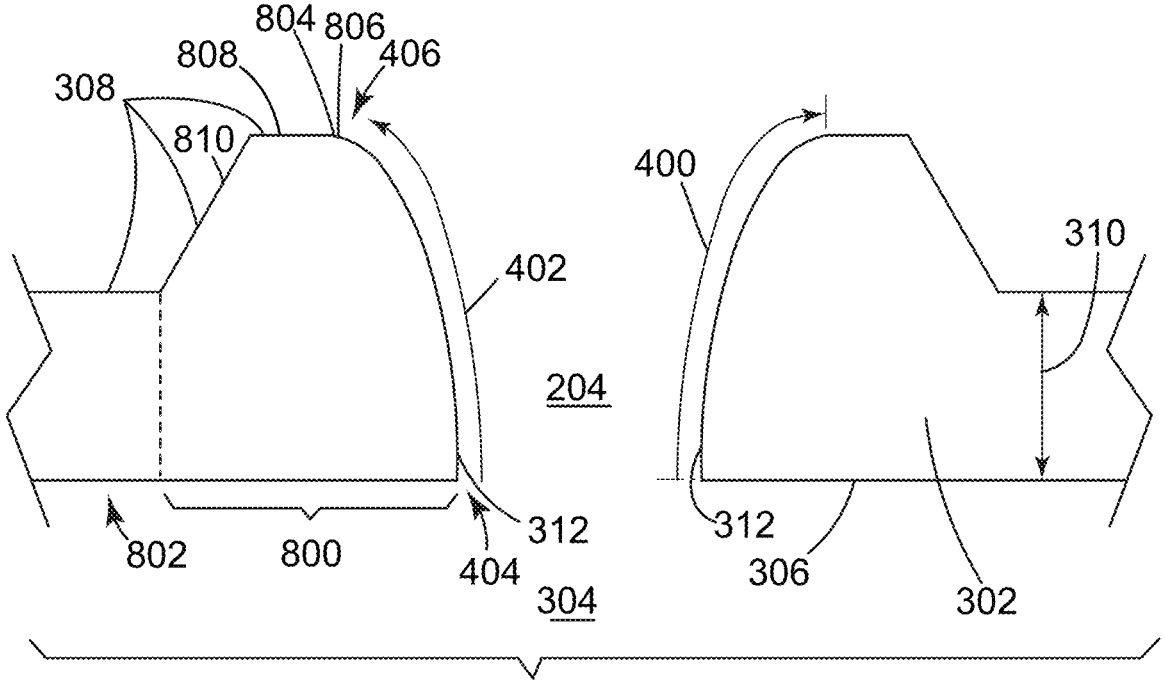
FIG. 8 is a cross-sectional view taken along line 4-4 of a fluid intake hole of FIG. 3, according to an alternate embodiment of the disclosure.
Figure 9:
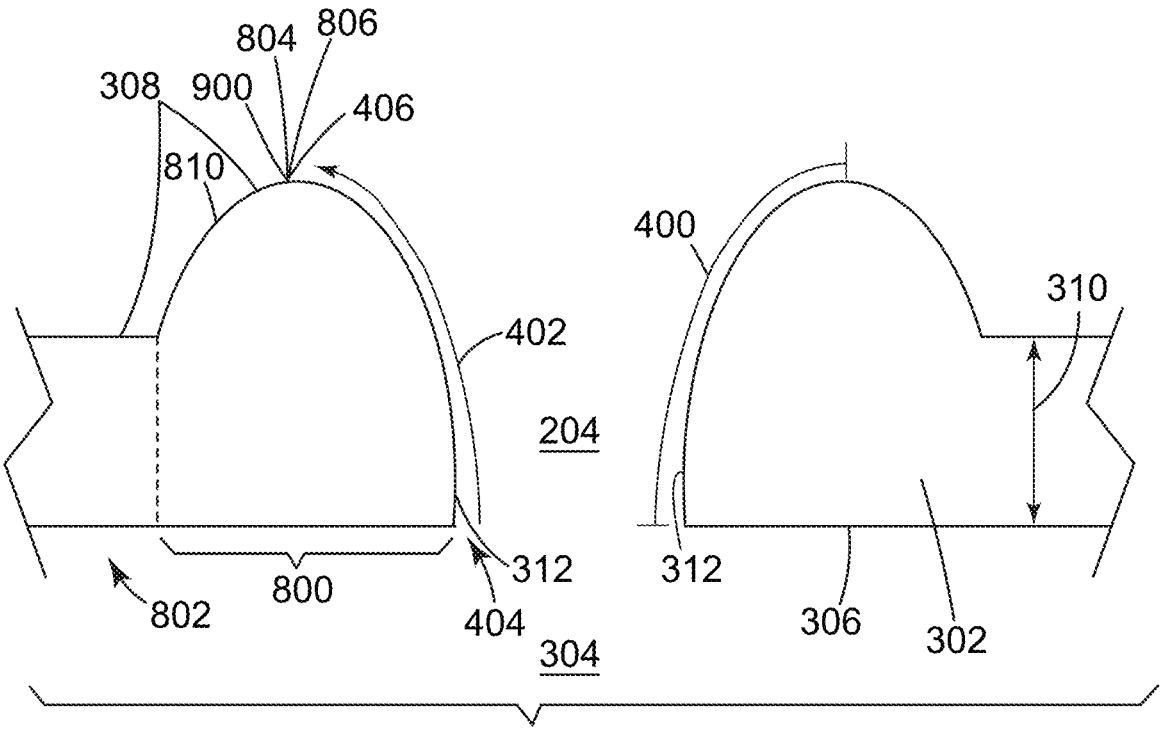
FIG. 9 is a cross-sectional view taken along line 4-4 of a fluid intake hole of FIG. 3, according to an alternate embodiment of the disclosure.

Referring to FIGS. 8 and 9, the duct wall 302 may include a boss portion 800. The boss portion 800 is immediately adjacent to and surrounds the fluid intake hole 204. The boss portion 800 includes the lateral-facing surface 312 and is disposed between the fluid intake hole 204 and a sheet portion 802 of the duct wall 302, wherein the sheet portion 802 constitutes a majority of the duct wall 302. The boss portion 800 includes a transition 804 from the lateral-facing surface 312 to the outward-facing surface 308 at a zenith 806 of the boss portion 800 having a maximum thickness 310 of the duct wall 302 in the boss portion 800. The duct wall thickness 310 at the boss portion 800 is greater than the duct wall thickness 310 at the sheet portion 802. The zenith 806 of the boss portion 800 may be a flat outward-facing surface 808 (FIG. 8) or an apex curved surface 900 (FIG. 9).

In defining the fluid intake hole 204, the boss portion 800 may transition from the zenith 806 of the boss portion 800 to the sheet portion 802 of the duct wall 302 with a flat transition surface 810 (FIG. 8), with a curved transition surface 902 (FIG. 9) free of angled surface transitions, or combinations of flat and curved surfaces. It is noted that the transitions from the zenith 806 to the sheet portion 802 shown in FIGS. 8 and 9 may be substituted for one another.

The boss portion 800 and the sheet portion 802 may be a continuous and unitary structure free of joints between the boss portion 800 and the sheet portion 802, the boss portion 800 may be attached to the sheet portion 802 with a weld joint, or the boss portion 800 may be mechanically attached to the sheet portion 802.

The maximum thickness 310 of the duct wall 302 in the boss portion 800 may be at least 110% of the duct wall thickness 310 at the sheet portion 802, alternatively at least 120%, alternatively at least 130%, alternatively at least 140%, alternatively at least 150%, alternatively at least 175%, alternatively at least 200%, alternatively at least 250%, alternatively at least 300%.

The sheet portion 802 may be formed from any suitable material, including, but not limited to, nickel-based superalloys, cobalt-based superalloys, NIMONIC 263, or combinations thereof. As used herein, "NIMONIC 263" refers to an alloy including a composition, by weight, of 19-21% cobalt, 19-21% chromium, 5.6-6.1% molybdenum, 1.9-2.4% titanium, up to 1% iron, up to 1% aluminum, up to 0.5% silicon, up to 0.5% copper, up to 0.1% carbon, up to 0.01% boron, up to 0.01% sulfur, and a balance of nickel.

The boss portion 800 may be formed from any suitable material, including, but not limited to, nickel-based superalloys, cobalt-based superalloys, steels, HASTELOY 230, or combinations thereof. As used herein, "HASTELOY 230" refers to an alloy including a nominal composition, by weight, of 22% chromium, 14% tungsten, about 2% molybdenum, up to 3% iron, up to 5% cobalt, 0.5% manganese, 0.4% silicon, 0.3% aluminum, 0.10% carbon, 0.02% lanthanum, up to 0.015% boron, and a balance of nickel.

In one embodiment, the boss portion 800 at the inward-facing surface 306 of the duct wall 302 is flush with the inward-facing surface 306 of the sheet portion 802 of the duct wall 302 such that the plenum 304 is free of intrusion of the boss portion 800 into the plenum 304.

Figure 10:
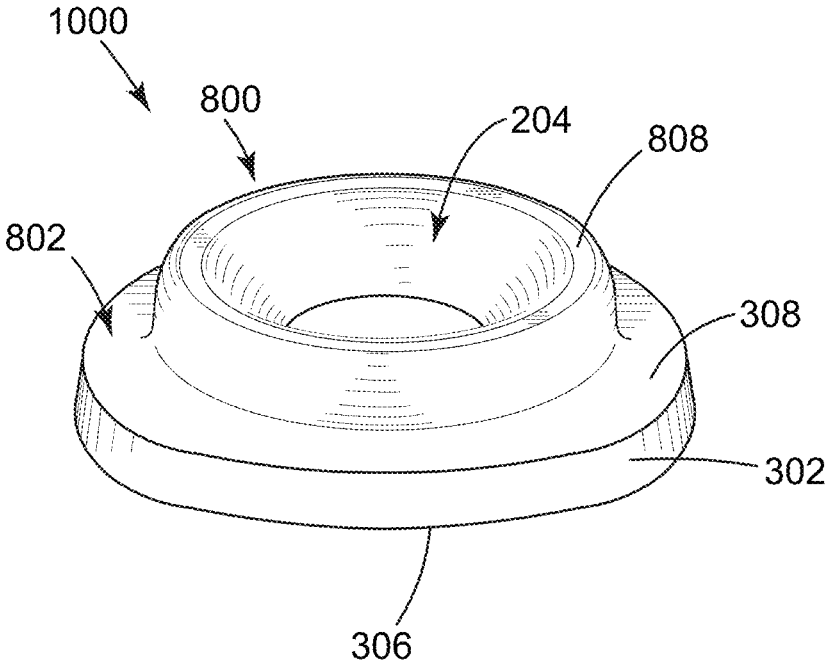
FIG. 10 is a perspective view of an insert with a boss for a fluid intake hole, according to an embodiment of the disclosure.
Figure 11A:
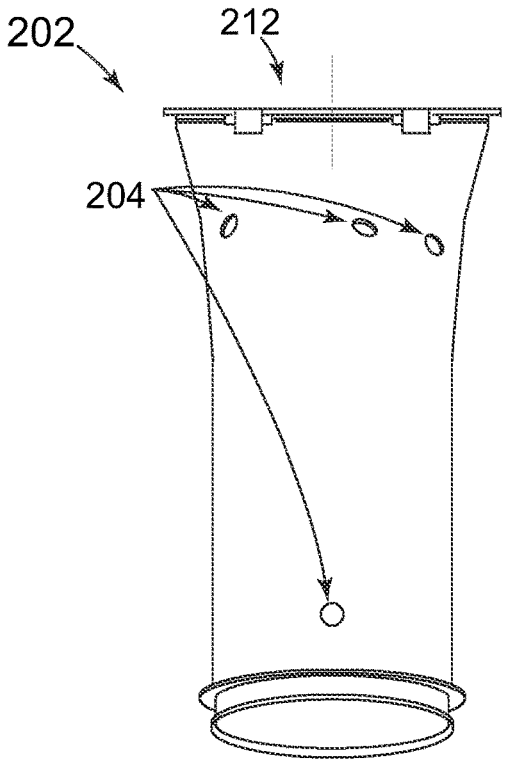
FIG. 11A presents a representative view of a transition piece including fluid intake holes from the top, according to an embodiment of the disclosure.
Figure 11B:
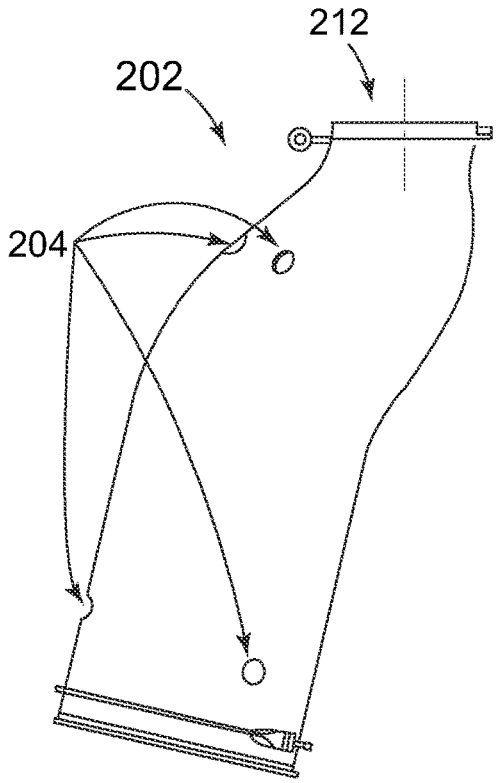
FIG. 11B presents a representative view of the transition piece including fluid intake holes of FIG. 11A from the side, according to an embodiment of the disclosure.
Figure 11C:
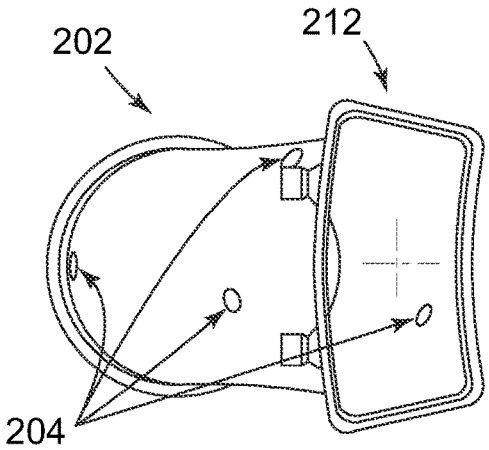
FIG. 11C presents a representative view of the transition piece including fluid intake holes of FIG. 11A from downstream, according to an embodiment of the disclosure.
Figure 11D:
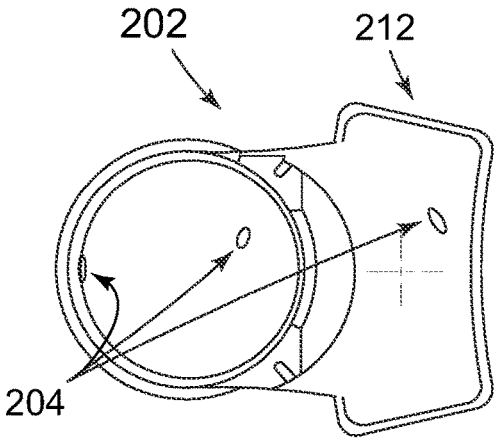
FIG. 11D presents a representative view of the transition piece including fluid intake holes of FIG. 11A from upstream, according to an embodiment of the disclosure.

Referring to FIG. 10, in one embodiment the boss portion 802 is formed primarily independently of the sheet portion 802 as an insert 1000. This insert 1000 may be formed by any suitable process, including, but not limited to, casting, machining, additive manufacturing, or combinations thereof. The insert 1000 may include a portion that will become part of the sheet portion 802 when the insert 1000 is joined to the duct body 300. The duct body 300 may include an aperture in the duct wall 302 thereof, such that the insert 1000 may be inserted therein and attached to the duct body 300 by welding, mechanical attachment, or both.

Referring to FIG. 2, the gas turbine combustion duct may be a transition piece 202, a combustion liner 201 of the combustor 16, or a unibody combustor. Referring to FIGS. 11A-D, in one embodiment, in which the gas turbine combustion duct 200 is a transition piece 202, the fluid intake holes 204 are dilution holes 206 that direct air into the plenum 304 that routes a flow of combustion products from the head end 210 of the combustor 16 through the gas turbine transition piece 202 to the gas turbine first stage nozzle 30 disposed in the turbine section 18.

EXAMPLES

Figure 12:
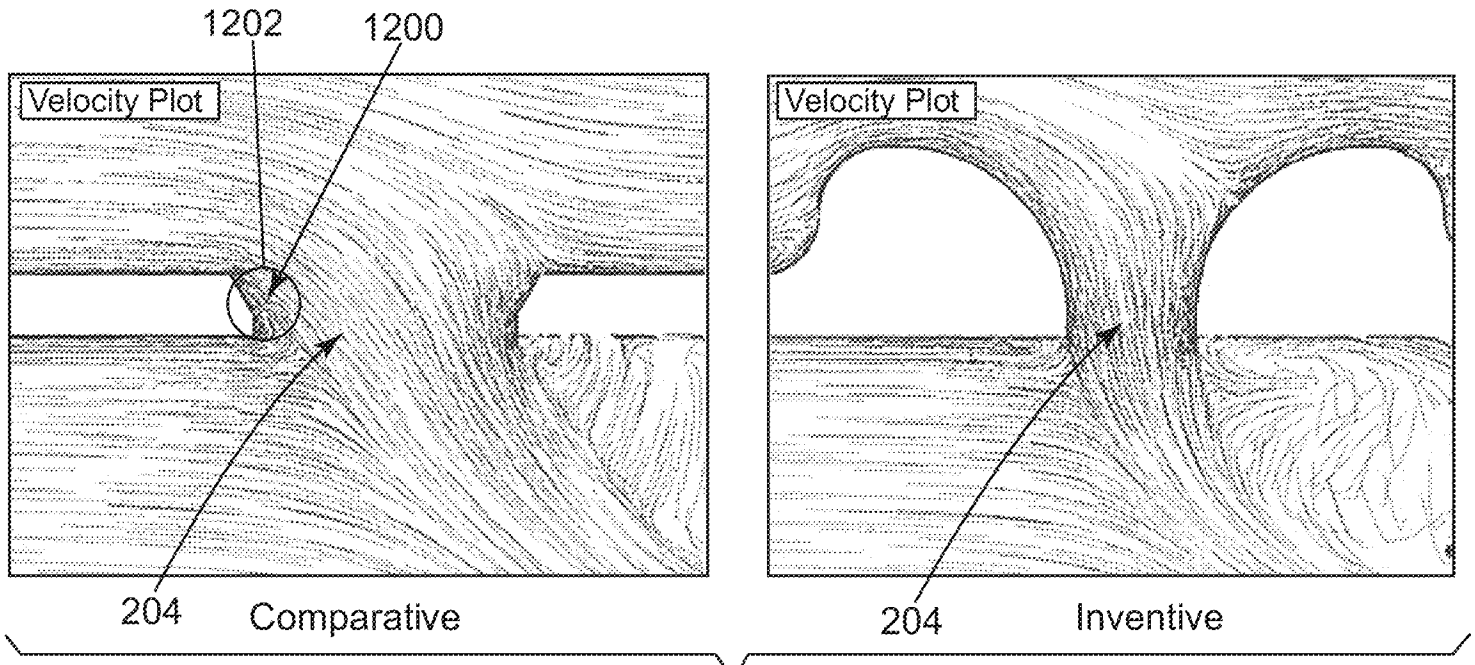
FIG. 12 presents modeling of comparative and inventive fluid intake holes, wherein the comparative fluid intake hole includes an angled surface transition (beveled edge), and the inventive fluid intake hole does not.

FIG. 12 presents computational fluid dynamics (CFD) modelling of comparative and inventive fluid intake holes 204 (specifically, dilution holes 206), wherein the comparative dilution hole 206 includes an angled surface transition 1200 (a beveled edge) between the inward-facing surface 306 and the outward-facing surface 308, and the inventive dilution hole 206 does not. The presence of the angled surface transition 1200 in the comparative example gives rise to an ingestion zone 1202 characterized by ingestion of the stream of combustion products into the fluid intake hole 204 against the flow of the external fluid into the plenum 304, whereas the inventive example, lacking the angled surface transition 1200, does not. Accordingly, the present fluid intake holes 204 (including dilution holes 206 and mixing holes 208) reduce thermal stresses in the duct wall 302 surrounding the fluid intake holes 204, thereby extending the useful life of such gas turbine combustion ducts 200.

While the gas turbine combustion ducts 200 with the present fluid intake holes 204 have been described with reference to preferred embodiments, it will be understood by those skilled in the art that various changes may be made, and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this technology, but that the present disclosure will include all embodiments falling within the scope of the appended claims.

What is claimed is:

1. A gas turbine combustion duct, comprising:

a duct body having an upstream end and a downstream end, the duct body including a duct wall defining a plenum for routing a flow of combustion products from upstream in a combustor through the gas turbine combustion duct downstream to a turbine section of a gas turbine, the duct wall having an inward-facing surface adjacent to the plenum, an outward-facing surface opposite the inward-facing surface, and a duct wall thickness between the inward-facing surface and the outward-facing surface;

a fluid intake hole extending from the outward-facing surface to the inward-facing surface through the duct wall thickness for receiving a fluid flow of an external fluid from outside the plenum into the plenum, the fluid intake hole being laterally circumscribed about its entire periphery between the outward-facing surface and the inward-facing surface by a lateral-facing surface; and a boss portion of the duct wall, the boss portion:

being immediately adjacent to and surrounding the fluid intake hole and including the lateral-facing surface;

being continuously solid other than the fluid intake hole;

being disposed between the fluid intake hole and a sheet portion of the duct wall, the sheet portion constituting a majority of the duct wall such that the fluid flow of the external fluid from outside the plenum flows along the sheet portion, over the boss portion, and into the fluid intake hole along the lateral-facing surface; and including a transition from the lateral-facing surface to the outward-facing surface at a zenith of the boss portion having a maximum thickness of the duct wall in the boss portion, the duct wall thickness at the boss portion being greater than the duct wall thickness at the sheet portion, wherein:

the lateral-facing surface includes a curved surface portion along a shortest path from the inward-facing surface to the outward-facing surface;

the lateral-facing surface is free of angled surface transitions along the shortest path between the inward-facing surface and the outward-facing surface; and the fluid intake hole is wider at the outward-facing surface than at the inward-facing surface.

2. The gas turbine combustion duct of claim 1, wherein the gas turbine combustion duct is selected from the group consisting of a transition piece, a combustion liner, and a unibody combustor.

3. The gas turbine combustion duct of claim 1, wherein the fluid intake hole is either a dilution hole or a mixing hole.

4. The gas turbine combustion duct of claim 1, wherein the lateral-facing surface includes a frustoconical topology immediately adjacent to the inward-facing surface.

5. The gas turbine combustion duct of claim 1, wherein the lateral-facing surface is disposed within 2 degrees of perpendicular from the inward-facing surface adjacent to a joint between the inward-facing surface and the lateral-facing surface.

6. The gas turbine combustion duct of claim 1, wherein the outward-facing surface and the lateral-facing surface meet at a radiused joint.

7. The gas turbine combustion duct of claim 1, wherein the lateral-facing surface curves along the entirety of the shortest path from the inward-facing surface to the outward-facing surface.

8. The gas turbine combustion duct of claim 1, wherein the zenith of the boss portion is a flat outward-facing surface.

9. The gas turbine combustion duct of claim 1, wherein the zenith of the boss portion is an apex curved surface.

10. The gas turbine combustion duct of claim 1, wherein, in defining the fluid intake hole, the boss portion transitions from the zenith of the boss portion to the sheet portion of the duct wall with a curved transition surface free of angled surface transitions.

11. The gas turbine combustion duct of claim 1, wherein the boss portion and the sheet portion are a continuous and unitary structure free of joints between the boss portion and the sheet portion.

12. The gas turbine combustion duct of claim 1, wherein the boss portion is attached to the sheet portion with a weld joint.

13. The gas turbine combustion duct of claim 1, wherein the boss portion is mechanically attached to the sheet portion.

14. The gas turbine combustion duct of claim 1, wherein the maximum thickness of the duct wall in the boss portion is at least 150% of the duct wall thickness at the sheet portion.

15. The gas turbine combustion duct of claim 1, wherein the sheet portion of the duct wall is formed of NIMONIC 263, and the boss portion is formed of HASTELOY 230.

16. The gas turbine combustion duct of claim 1, wherein the boss portion at the inward-facing surface of the duct wall is flush with the inward-facing surface of the sheet portion of the duct wall such that the plenum is free of intrusion of the boss portion into the plenum.

17. The gas turbine combustion duct of claim 1, wherein the boss portion is symmetric around the fluid intake hole.

* * * * *